United States Patent [19]

Lübben et al.

[11] 4,452,653

[45] Jun. 5, 1984

[54] METHOD OF COATING AMMUNITION WITH A PROTECTIVE SURFACE LAYER

[75] Inventors: Manfred Lübben, Celle; Wolfram Witt, Duesseldorf, both of Fed. Rep. of Germany

[73] Assignee: Rheinmetall GmbH, Duesseldorf, Fed. Rep. of Germany

[21] Appl. No.: 326,919

[22] Filed: Dec. 2, 1981

Related U.S. Application Data

[60] Division of Ser. No. 112,110, Jan. 17, 1980, Pat. No. 4,363,273, which is a continuation-in-part of Ser. No. 885,323, Mar. 10, 1978, abandoned.

[30] Foreign Application Priority Data

Mar. 10, 1977 [DE] Fed. Rep. of Germany ..... 2710451

[51] Int. Cl.[3] ..... C06B 45/22

[52] U.S. Cl. ..... 149/11; 149/10; 102/431; 264/3 R

[58] Field of Search ..... 102/290, 431; 149/10, 149/11; 264/3 R

[56] References Cited

U.S. PATENT DOCUMENTS

| | | | |
|---|---|---|---|
| 3,079,289 | 2/1963 | George et al. | 154/43 |
| 3,727,512 | 4/1973 | Berger | 102/103 |
| 3,730,094 | 5/1973 | Quinlan | 102/38 |
| 3,954,063 | 5/1976 | Kaufman et al. | 102/103 |
| 3,987,731 | 10/1976 | Brzuskiewicz | 102/38 |
| 4,004,523 | 1/1977 | Clifford et al. | 102/103 |
| 4,009,231 | 2/1977 | Wasserman et al. | 102/103 |
| 4,091,729 | 5/1978 | Bell et al. | 102/103 |
| 4,304,185 | 12/1981 | Sayles | 149/19.2 |
| 4,363,273 | 12/1982 | Luebben et al. | 102/290 |

FOREIGN PATENT DOCUMENTS

| | | | |
|---|---|---|---|
| 1200184 | 9/1965 | Fed. Rep. of Germany | 149/10 |
| 2550208 | 5/1977 | Fed. Rep. of Germany . | |

*Primary Examiner*—Edward A. Miller

[57] ABSTRACT

A protective surface coating for ammunition having no cartridge casing and ammunition having a combustible cartridge casing. A body of highly porous nitrocellulose is permeated from the outside with a polymer carried by a solvent to form a binder for the body. A layer of metal platelets containing airpockets is bound to the body with a binding polymer. The metal platelets are covered with an outer coating of a rapidly curing resin. The protective coating is used to prevent the penetration of moisture into the porous cartridge casing or into the powder mass itself and to provide improved stability to heat and flames.

10 Claims, 1 Drawing Figure

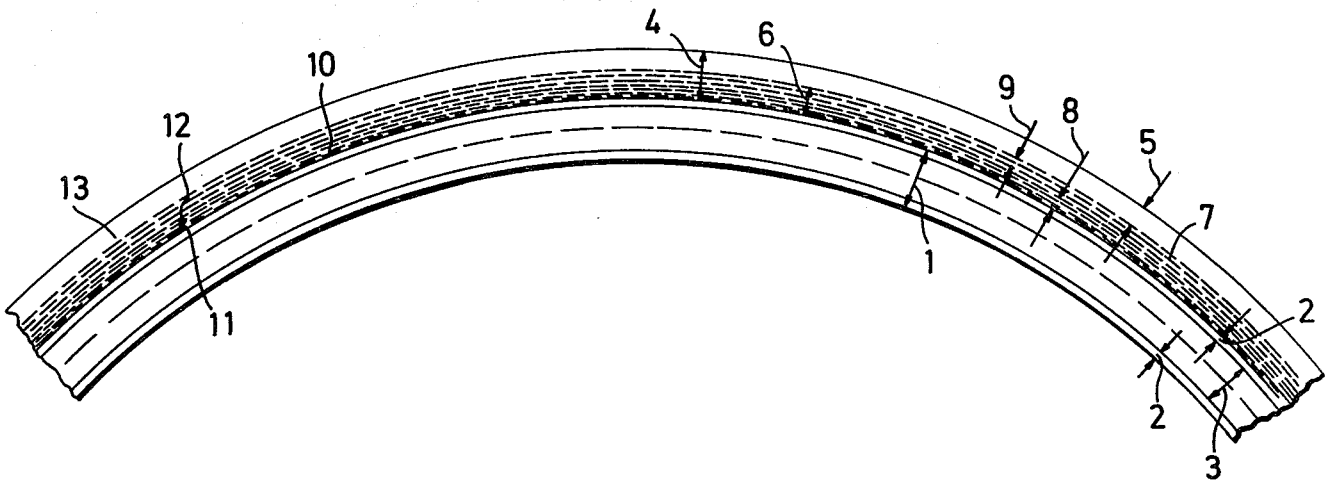
1
2
3
4
5
6
7
8
9
10
11
12
13

METHOD OF COATING AMMUNITION WITH A PROTECTIVE SURFACE LAYER

CROSS REFERENCE TO RELATED APPLICATIONS

This application is a division of application Ser. No. 112,110, filed Jan. 17, 1980, now U.S. Pat. No. 4,363,273, which is a continuation-in-part of application Ser. No. 885,323, filed Mar. 10, 1978, now abandoned.

BACKGROUND OF THE INVENTION

1. Field of the Invention

The present invention relates to an improved ammunition having a body covered with a protective layer and to a method of making same.

2. Description of the prior Art

It is known to provide protective coatings for nitrocellulose ammunition cases.

For example in German published application No. 1 912 727 there is disclosed a porous, combustible casing made out of a swellable, expandable, natural or synthetic polymer or a derivative thereof which acts as a barrier. This barrier layer in turn, after its solidification, is provided with a moisture-proof, protective layer.

Published German application No. 1 578 062 discloses a combustible cartridge having no housing with a coating consisting of a highly combustible film, the film containing a mixture of dyes, pigments, or metal powder (for example aluminum or zinc). J. Brzuskiewicz in U.S. Pat. No. 3,987,731 discloses a porous combustible cartridge case containing nitrocellulose, reinforcing fibers and a resinous binder, which is rendered resistant to water and oil by coating the surface with a composite coating containing an undercoating of polyvinyl alcohol and a top coating of a copolymer of vinylidene chloride and acrylonitrile.

In general, there is the requirement regarding ammunition having a combustible cartridge casing that an uncontrolled premature ignition of the ammunition due to contact with hot substances or parts either inside the weapon or outside the weapon is prevented while simultaneously not preventing the combustion of the ammunition at a preselected time. Additionally, it is desired that the protective surface coating shall provide moisture resistance and waterproofing as well as protection against deterioration resulting from fungi or contaminating oil.

The afore-described properties of the protective surface coating and particularly the ease of combustibility providing complete combustion without residues and the simultaneous presence of flame retarding characteristics are not met satisfactorily in any of the prior art ammunition. For example, the protective coatings of the German published applications Nos. 1 912 727 and 1 578 062 have satisfactory moisture resistant and waterproofing characteristics, but they are flammable and therefore do not solve the safety problem attendant upon combustible cartridge casings and ammunition having no cartridge casings.

The ammunition described in U.S. Pat. No. 3,987,731 uses as a starting material fiber reinforced nitrocellulose employing in particular acrylic fibers and as a binder polyvinylacetate resin. Nitrocellulose having a nitrogen content of up to about 12.6 weight percent has the disadvantage of dissolving easily when contacted with a dissolving solution such as with a xylene solution. This nitrocellulose with relatively low nitrogen content has no oxidation reserve and therefore one has to expect the formation of residues upon firing. The acetate of the binder of U.S. Pat. No. 3,987,731 forms only a physical bond with the nitrocellulose material, is also susceptible to solvents, and there is a considerable transmission of such a casing.

According to U.S. Pat. No. 3,987,731 a first layer of polyvinyl alcohol primer lacquer is employed and then a layer of polyvinylidene chloride acrylonitrile copolymer lacquer. The first layer is insoluble in the solvents of the polyvinylidene chloride acrylonitrile copolymer lacquer and for obtaining the heat protective effect such a large amount of aluminum is combined with the polyvinylidene chloride acrylonitrile copolymer as to make combustion without a residue very doubtful. Furthermore, the combustion of the polyvinylidene chloride results in chlorine and/or hydrochloric acid and their derivatives which can increase erosion of the container of the cartridge. The weight of the layer amounts to more than 1.1 to 6 weight percent of the total weight of the ammunition. Such an amount is excessively high and constitutes a serious drawback. The large amount of material forming the coating is not burned without any residue during firing.

The protective coatings of the state of the art, for the reasons enumerated hereinabove, have not satisfactorily solved the opposed and contradictory requirements that are involved, i.e., no satisfactory compromise has been found between the necessary protective effect desired and the external influence of heat and the necessary requirement of complete combustion without residue during the firing of the shell.

SUMMARY OF THE INVENTION

1. Purposes of the Invention

It is an object of the present invention to provide a protective surface coating for ammunition with or without a combustible cartridge casing, which coating has sufficient heat-insulating and heat-absorption characteristics to prevent excessive local heating and to distribute external heat over a sufficiently large surface thereby providing protection against accidental ignition of the ammunition and/or the combustion cartridge casing due to local excessive external heating.

It is a further object of the invention to provide a coating sufficiently delaying a possible ignition and having a composition leaving only a negligible residue after the firing of the projectile.

It is an additional object of the present invention to provide a coating which protects sufficiently against moisture or soiling by oil or any deterioration due to fungi.

It is a further object of the present invention that even under ignition inhibiting conditions such as for example malfunctioning of the smoke suctioning means or when the ammunition is soiled by oil or other material and/or is moist there will be a combustion of the cartridge without residue.

It is an additional object of the present invention to avoid an uncontrolled ignition due to contacting with hot parts, such as, for example, after-glowing or after-flaming material in the loading chamber of the weapon, and/or hot or combustible oil drops or lighted cigarettes and to provide a resistant and preferably impermeable surface against the operation of water vapor, water, machine oil and fungi.

These and other objects and advantages of the present invention will become evident from the description which follows.

2. Brief Description of the Invention

An improved ammunition of the present invention comprises a body of highly porous nitrocellulose permeated from the outside with a polymer carried by a solvent to form a binder for the body, an airy outer surface on the body is formed of a layer of metal particles coated and connected with a polymer, and an outer coating is formed of a rapidly cured resin on the airy outer surface layer of metal particles.

A process is also provided for producing an improved ammunition with a surface coating having at least one layer of lacquer comprising preparing a highly porous nitrocellulose body, permeating the highly porous nitrocellulose body with a polymer carried by a solvent, substantially removing the solvent, covering the outer surface of the body with a dispersion of metal platelets in a second polymer solution with the second solution solvent permeating into the body for effecting a solid connection between the porous body and the metal platelets, and covering the resulting metal platelet surface layer with a rapidly curing resin dissolved in a third solvent, the third solvent carrying the second polymer in part from the metal platelet layer into the porous body and thereby creating hollow spaces or air pockets near the metal platelets.

It has been found advantageous, for purposes of providing a complete protective effect, that is, a moisture-proof effect, resistance to oil and attack by fungi, and resistance to excessive exterior heating, to apply a first layer or coating in order to seal the pores of a combustible cartridge casing, respectively a body of powder mass, when dealing with ammunition having no cartridge casing, and thereafter to apply a second coating or layer consisting of a second polymer as a varnish or lacquer in which a metal powder is dispersed, and then applying as a final step a third coating consisting of an oil-moisture-and-fungi-resistant lacquer or varnish. Preferably there is added to the second polymer solution as a varnish or lacquer of the present invention 50–70 weight percent of metal powder, whereby the lower limit range is determined by the degree of decline in the ignition-inhibiting effect, whereas the upper limit of the range is determined by the decline in the adhesive capacity of the varnish or lacquer when it contains a high proportion of powder. When the metal powder consists of aluminum platelets their preferred concentration in the second polymer solution is from about 20 to 50 weight percent.

It has been determined that a particularly favorable effect is obtained by the addition of metal powder if the particles in the powder have the form of small platelets. A particle size of the powder of between 10 and 100 microns is effective. More preferred are powders having particle sizes from about 3 to 18 microns. The following metal powders have been found suitable and give particularly preferred results: aluminum powder, copper powder, zinc powder, as well as alloys, especially mixtures of these metal powders. Most preferred is aluminum powder in platelet form.

It was determined that on the one hand the desired and required adequate protective effect was only achieved when the combined coatings had reached a certain minimum thickness. Surprisingly, it was also determined that the total thickness of the various coatings does not need to exceed a certain maximum value because, once this maximum thickness is exceeded, there is no further increase in the protective effect afforded by the coating or layer. The thickness of the total coating can be from about 0.05 to 0.1 mm. A thickness of about 0.07 mm has proven to be an optimum value for the total thickness of the layers of the coating. This signifies that the necessary amount of coating substances, which are to be applied to the surface needs only to amount to about 80 g/m$^2$, which, in comparison to the state of the art, is considered to be very favorable, because the quantitative consumption for the protective surface coating, according to the present invention can be considered quite small. Preferably, the resulting covered body is aired for at least about 10 days.

In addition, such a thin coating layer avoids any type of difficulties regarding the ammunition tolerances and dimensions and the problems that may occur when such ammunition is inserted into a barrel of a certain caliber.

In the production of the protective coating of the present invention, there can first be produced the ammunition itself having a combustible cartridge casing or such ammunition without a cartridge casing including the projectile, and then there is applied a gapless coating. Thus with the method of the present invention the projectile and the cartridge casing or the body of the powder mass forming the ammunition without a cartridge casing are not first applied separately with the protective coating layers and then assembled because, if the method were to be accomplished in this fashion, there would result a crack or interruption in the coating at the juncture of the individual assembled parts. Such crack or juncture would permit the penetration of moisture, oil, or fungi. Moreover, when separately coating the individual parts of the ammunition, it has been found that the coating thickness must be substantially thicker to provide an adequate protective surface coating and to have sufficient resistance to mechanical stresses. This is particularly so in view of the fact that the ammunition is subjected to further handling and operations before it reaches a finished state.

The aforedescribed drawback is avoided with the present invention in view of the fact that the ammunition is immediately packed after the application of the coating layers and is not further handled prior to its actual use. For this reason it is not necessary to make the protective coating of the present invention particularly resistant to scratching.

It has been determined during firing tests with ammunition having the protective surface coating in accordance with the present invention that the barrel erosion, when compared to that produced by conventional ammunition, is considerably reduced. While we do not wish to be bound by any theory, it is assumed that the protective surface coating during combustion of the cartridge casing or of the powder body forms a protective surface layer in the barrel which prevents or at least reduces the direct attack of the hot powder gases upon the inner surfaces of the barrel.

In accordance with the present invention a coating for ammunition has been found wherein for example for a total weight of an ammunition charge of 7700 g the weight of the coating amounts to at most about 20 g which is less than about 0.27 weight percent of the total weight. This coating and the easily combusted cartridge material are completely burned during firing without leaving any residue. Thus with the ammunition of the present invention the gun barrel receives improved characteristics for the sliding of projectiles therethrough. Erosion of the gun barrel is considerably reduced so that in lieu of the conventional 50 round firing capacity the gun barrels using the ammunition of the present invention can be fired up to tenfold of such conventional values; and this allows about 500 rounds to be fired without an exchange of gun barrels.

The invention accordingly consists in the features of construction, arrangement of parts and series of steps which will be exemplified in the process and article of manufacture hereinafter described and of which the scope of application will be indicated in the appended claims.

BRIEF DESCRIPTION OF THE DRAWING

In the accompanying drawing, in which is shown one of the various possible embodiments of the invention, the sole FIGURE is a schematic sectional view of the layers of a cartridge improved with the coating of the present invention.

DETAILED DESCRIPTION OF THE INVENTION AND PREFERRED EMBODIMENTS

In accordance with the present invention a body of highly porous nitrocellulose is prepared. The body can have the shape of a cartridge casing or that of any form useful in ammunition manufacture. In general, initially a pulp of nitrocellulose and reinforcing fibers is prepared. The reinforcing fibers are preferably derived from cellulose. They can be obtained as kraft cellulose by reducing wood chips in conventional fashion with an aqueous solution of sodium hydroxide and sodium sulfide under elevated temperature and pressure. After digesting, the reaction product is a fiber mass which is washed to free it from chemicals. Preferably the nitrocellulose contains at least about 13 weight percent of nitrogen and more preferably from about 13.2 to 13.4 weight percent nitrogen. The relative weight ratio of nitrocellulose to fibers can be preferably from about 1.8 to 2.5. The pulp can be formed as desired for the resulting ammunition. Additives can be incorporated in the ammunition body. Such additives include binders and stabilizers. The binders can be resins and are preferably two-component polyurethane resins. The amount of binder employed depends on the nature of the binder. A preferred amount of binder is from about 9 to 13 weight percent of the ammunition body.

Preferably initially a raw form of nitrocellulose and fibers is formed from the pulp and pressed for obtaining a suitable wall thickness. Such wall thicknesses can be for example from about 3 to 4 mm. During the pressing, the residual moisture is preferably decreased to less than about 3 weight percent and ranges preferably below about 2 weight percent. After complete drying of the raw mold the body is preferably drenched with a solution of the resin. After evaporation of the solvent for the resin a highly porous body is obtained. The drying temperature is preferably from about 80° C. to 130° C. The density of the nitrocellulose body is preferably from about 0.8 to 1 g/cm$^2$.

By drenching or soaking of the body with resin there is obtained a large gradient of resin concentration with higher values at the surface of the body and lower values at the inside of the body. As a result the nitrocellulose content near the surface is lower compared with the inside of the body. The surface of the body is thereby densified and even before applying any final protective coatings the surface already constitutes a protective layer against contamination and such protection is particularly effective against water. Such a surface also exhibits heat protective properties.

Solvents for the applied resin for drenching the body depend on the resin. For example, solvents for polyurethane are generally free of water and do not have hydroxyl groups or other active groups. Solvents include polar and nonpolar organic solvents and solvent mixtures, which can comprise, for example, liquid aromatic hydrocarbons such as xylene and esters. A preferred solvent is zylene. The solvent should furthermore have a boiling point sufficiently low to provide for easy drying. This is necessary for removing the solvent substantially after permeating the highly porous nitrocellulose body with a polymer resin carried by the solvent.

Employing polyurethane as a binder in accordance with the present invention results in a reticulation of the material of the body resulting in high strength and a lower transmission of the body compared with conventional cartridges such as those of U.S. Pat. No. 3,987,731.

A stabilizer can also be incorporated in the ammunition body. The amount of stabilizer preferably is from about 0.4 weight percent to 1.5 weight percent of the total ammunition body. Suitable stabilizers include diphenylamine stabilizers. Preferably a stabilizer sold under the trademark Arkadite II is employed.

The resulting body in general preferably comprises from about 55 to 65 weight percent of nitrocellulose, from about 25 to 30 weight percent of cellulose fibers, from about 9 to 13 weight percent of a resin such as a two-component polyurethane resin and about from 0.4 to 1.5 weight percent of a stabilizer. One preferred composition of the body involves from about 55 to 59 weight percent of guncotton, from about 29 to 33 weight percent of cellulose fibers, from about 9 to 13 weight percent of a polyurethane resin and from about 0.4 to 1.5 weight percent of a stabilizer. Another preferred composition of the improved ammunition of the present invention has a body of a composition of from about 59 to 63 weight percent of guncotton, from about 25 to 29 weight percent of cellulose fiber, from about 9 to 13 weight percent of a polyurethane resin and from about 0.4 to 1.5 weight percent of a stabilizer.

The finished ammunition body is first completely assembled and then the coating of the present invention is applied. This prevents a change in the ammunition after production of the coating of the present invention since possible permeable spots which can arise for example at the joint between the projectile point and the cartridge are sealed by the coating.

The formation of the coating is preferably achieved by employing two coating steps not counting, however, a possible step of solvent dispersion on the surface for moving coating material in part into the body of nitrocellulose and fibers.

The two step process is preferred in order to keep the coating weight and the coating thickness low for maintaining the combustibility of the ammunition body. In general, these requirements can only be achieved by employing at least two steps in the formation of the coating providing full protection for the ammunition body. For example, in an ammunition having a cartridge surface of about $\frac{1}{4}$ m$^2$ these requirements can be met by a coating weight of as low as 13 to 14 grams per cartridge. However, the coating weight can be increased up to the range of 18 to 20 grams in this example. The first coating step covers the outer surface of the body with a dispersion of metal platelets in a second polymer solution with the second solution solvent permeating into the body for effecting a solid connection between the porous body and the metal platelets. The second polymer solution can be a solution as employed for example in the German published application No. 1 912 72. This treatment is effective to close and seal the pores of the combustible cartridge casing or the powder body itself.

The following adhesive resins are suitable as polymers based on their good filler-absorbing characteristics, and they also have satisfactory heat resistance characteristics and also provide a good barrier action against water vapor and partially as well against water. Suitable resins include:

1. physically dry resins:
   butyl rubber, also mixed with polyterpene resins,
   cyclized rubber(9cyclo rubber), or
   novolaks, also mixed with polyvinylbutyrals,
2. single component resins:
   urethane alkyd resins,
   alkyd resins mixed with polyvinyl butyrals or
   polyurethane resins.

A preferred second polymer is cyclorubber. Cyclorubber has the approximate formula of $(C_5H_8)_x$, which formula is about the same as that of natural rubber. Cyclorubber can be prepared from natural rubber in accordance with German Pat. Nos. DRP 675,564 issued July 7, 1936 and DRP 705,399 issued Sept. 15, 1939. A survey about cyclorubber is provided in the book by Hans Wagner and Hans Friedrich Sarx: "Kunstharzlacke", Carl Hanser Verlag, Munich 1971, pages 256–257. Cyclorubber in general has a melting point of about 130° C. to 140° C. and is dissolvable in most nonpolar solvents. Such solutions can be thinned down with most polar solvents. Preferred solvents include $C_7$–$C_{15}$ hydrocarbons, turpentine, toluene, benzene, xylene, liquid aromatic hydrocarbons, tetrahydronaphthalene, decahydronaphthalene chlorinated hydrocarbons such as trichloroethylene and ketones such as cyclohexanone. More preferred as a solvent is xylene. Preferable cyclorubbers are those which are copolymerized for providing rapidly curable binders. Such copolymers include copolymers with styrene, methylstyrene or butylmethacrylate. Such a product is available from Reichold Albert Chemie AG. as Alpex CK 450.

The afore-recited single component resins either harden oxidatively in the air or are crosslinked as a result of air humidity, even at room temperature, with sufficient speed. Even though no particular demands are made upon these coatings insofar as their resistance to oil is concerned, the satisfactory resistance of novolaks, urethane alkyd resins and polyurethane resins with respect to lubricating and hydraulic oils is considered to be an additional advantage.

The second polymer solution has dispersed metal particles preferably in platelet form. Particle sizes between 10 and 100 microns are effective and preferred metal powders have particle sizes from about 3 to 18 microns. Suitable metal powders include aluminum powder, copper powder, zinc powder as well as alloys, especially from mixtures of these metals. Most preferred is aluminum powder in platelet form. The amount of metal, or in particular of aluminum, in the resin solution is limited by the required full wetting of all metal particles, which is necessary to achieve a sufficient adhesion of the metal layer on the body. The dispersion of metal platelets in the second polymer solution comprises from about 5 to 10 weight percent of the second polymer.

The thickness of the metal containing layer is preferably from about 0.04 to 0.06 mm. The average density of the metal containing layer is preferably from about 0.95 to 1.08 g/cm$^2$ in the case of aluminum in the final product. In applying the dispersion of metal platelets to the ammunition body the solvent penetrates into the nictrocellulose body and forms at the surface of the body a zone enriched in second polymer such as cyclorubber, which provides a solid bond between the metal particle layer and the ammunition body.

The metal platelet surface layer is covered with a rapidly curing resin dissolved in a third solvent. The resulting covering layer of the surface coating consists of a cross-linked covering lacquer or varnish. With such a varnish or lacquer the best resistance to oils and water can be achieved. As raw materials for the lacquer or varnish serving as rapidly curing resin phenolic groups have been found to be suitable as building blocks for the lacquer system especially in the middle and higher number of phenolic groups. The hardening and curing of these varnishes and lacquers is effected:

with phenolic resins by the addition of siccative;

in the case of phenolic resins containing epoxides by the addition of "Versamides";

when using resols by the addition of special hardeners. ("Versamide" is a registered trademark of Schering AG. of Berlin, West-Germany and covers a variety of polyamide type products.)

In addition to the above-mentioned resin types, there can be also used for the covering layer the urethane-alkyd-resins or the polyurethane resins, which are preferred as heat-insulating layers.

Preferred outer coatings include polyurethane resins. Such resins are obtainable by polymerization of isocyanates. For example an isocyanate can react with water to form an amine and the amine can start a polymerization by reacting with an isocyanate to form a substituted urea and the substituted urea can react with further urea to form a substituted carbamylurea, and so on. Preferred isocyanates are those which are not volatile and which exhibit low toxicity during application. Such isocyanates include the addition products of toluenediisocyanate with polyhydroxyl compounds; for example, three moles of toluenediisocyanate are reacted with one mole of trimethylolpropane to obtain a preferred isocyanate.

A preferred polyurethane resin is distributed by Reichold Albert Chemie AG. as "Beckocoat PU 428". The polyurethane is generally applied in a solution. Solvents for the polyurethane are generally free of water and do not have hydroxyl or other active groups. Solvents include organic solvents and solvent mixtures which may comprise liquid aromatic hydrocarbons such as xylene and esters. Xylene is a preferred third solvent for the polyurethane employed as the rapidly curing resin.

The third solvent dissolves part of the second polymer previously applied to the ammunition body and carries the second polymer further into the interior of the body and this transport of the solvent is enhanced by capillary activity. Thus an air-containing or airy metal layer reduced in resin content results. The polyurethane of the outer covering layer hardens in a very short time which is generally less than about ten minutes and does not penetrate the metal layer, since it is present in a prepolymerized form of a large molecular weight and therefore exhibits only limited flow capabilities. The thickness of the cured outer coating is preferably from about 0.015 to 0.03 mm. The toal thickness of the coating of the body is preferably from about 0.05 to 0.1 mm. The formation of the airy metal layer increases especially the stability toward the effects of heat.

Compared with conventional cover layers such as those disclosed for example in U.S. Pat. No. 3,987,731, according to the present invention the amount of aluminum can be considerably reduced. This assures a completely residue free combustion of the body with the protective coating. The process for obtaining the improved ammunition of the present invention can be controlled effectively by the solvent concentration. For example, when xylene is employed as the solvent, a higher concentration of xylene can increase the stability toward heat, since the xylene flows to the interior of the body. Furthermore, by increasing the amount of xylene the effectiveness against easy ignition can be increased. In addition, the body can be sprayed with additional solvent to increase the migration of the second polymer before applying the outer covering layer.

The solvent of the outer cover layer is easily resorbed by the body in the course of the carrying process. For example cyclorubber is easily dissolved by the third solvent of the present invention and is transported toward the ammunition body. At the contact of the body with the metal layer this results in increased bonding. At the same time an airy metal layer with reduced resin content is formed. The congruence of the formation of the body with the adjustment of the process of applying the various layers is an important aspect of the present invention.

Referring now to the drawing there is shown schematically the construction of the layers of the present invention and of the influence of the solvent, for example of xylene, on the achievement of such a product. The total body in this embodiment is a cartridge and is designated 1. The inner body is designated 3 and two outer zones are designated 2. The total layers are designated 4. The total layers comprise the metal layer 6 and the outer cover layer 5. The metal layer 6 is again separated in a zone 9 of reduced resin content and in a layer 8 with increased resin content. 7 designates in the layer of reduced resin content the aluminum layer construction as a porous air-containing aluminum structure.

On the left side of the drawing there is indicated the effect of the solvent. In the outer region 13 there is an excess of solvent. By capillary action the solvent is transported into the outer cartridge zone 10. The arrow between the numbers 11 and 12 indicates how the second resin such as cyclorubber is washed by the solvent into deeper layers resulting in an air pocket enriched porous aluminum structure.

EXAMPLE

The production of the cartridge is performed in the following way: First, pulp material consisting of nitrocellulose and kraft cellulose is prepared. From this pulp material there is formed a blank which is subjected to a pressing process so that it is converted into a solid sheet material having a wall thickness of about 3.3 mm and a residual moisture content of about 2 weight percent. After complete drying the formed material is soaked in a lacquer dissolved in xylene, the components of which are an isocyanate and a polyether mixture. The lacquer is formed with one part isocyanate for three parts polyether (respectively polyester) and four to five parts xylene. The xylene displaces during soaking the air in the dried formed body of the cartridge material.

The lacquer now deposits between the fibers of the cartridge. The deposits occur preferably in the regions close to the surface of the body comparable to a chromatographic effect. After a soaking of about three to four minutes the drying is effected by evaporating the xylene and a lattice-like polymerization of the polyurethane is induced at a temperature of about 115° C. for about 15 to 20 minutes. The soaking in polyurethane results in a large gradient from the surface down to the interior of the polyurethane concentration.

The preferred material compositions of an impact round (KE) and of a multiple purpose round (MZ) are listed in the following table. The exact compositions for an impact projectile and a multiple purpose cartridge are as follows:

| | Impact Projectile weight percent | Multiple Purpose Cartridge weight percent |
|---|---|---|
| Guncotton (13.2 to 13.4 weight percent nitrogen) | 52.2 ± 1.5 | 60.7 ± 1.5 |
| Kraft cellulose | 31.0 ± 1.5 | 27.3 ± 1.5 |
| Two component polyurethane resin | 11.0 ± 1.5 | 11.2 ± 1.5 |
| Arkadit II | 0.8 ± 0.4 | 0.8 ± 0.4 |

The prepared cartridge is finished and thereafter the coating is applied. Two layers are employed besides a soaking with xylene. This results in a low layer weight and in a low layer thickness. An ammunition body with a surface of about $\frac{1}{4}$ $m^2$ was covered with total layers having a weight of about 20 grams. The metal layer was provided by dispersion with a cyclorubber easily dissolvable in xylene. Aluminum platelets were dispersed in this solution. The xyxlene permeated the body surface and formed a zone enriched in cyclorubber at the surface of the body.

The outer covering layer was provided by a polyurethane resin dissolved in xylene. The xylene in the outer covering layer dissolves the cyclorubber and drives it further into the ammunition body and the xylene transport is supported by capillary effects. A layer of aluminum platelets containing air pockets and a reduced content of resin results. The polyurethane hardens within about 10 minutes and does not penetrate into the aluminum layer.

The following properties were observed with the product:

The water permeability accoring to DIN No. 53123 was found to be 2 $g/m^2$ per day. The water absorption of a manufactured cartridge at 25° C. and at a relative air humidity of 95% was found to be 2.5 g after four days and 10 g after 21 days. The residue after firing under unfavorble conditions was less than 0.1 g per cartridge. Upon applying a lighted cigarette to the cartridge, upon the dropping of hot machine oil having a temperature of 250° C. upon the cartridge, or dropping burning machine oil onto the cartridge, no ignition was observed.

Although the invention is illustrated and described with reference to a plurality of preferred embodiments thereof, it is to be understood that it is in no way limited by the disclosure of such a plurality of embodiments, but is capable of numerous modifications within the scope of the appended claims.

We claim:

1. A process for producing an improved ammunition having a surface coating with at least one layer of lacquer, comprising:

(a) the steps of preparing a highly porous nitrocellulose body;

(b) permeating the highly porous nitrocellulose body with a first polymer which is dispersed in a first solvent;

(c) substantially removing the first solvent;

(d) covering the outer surface of the body with a dispersion of metal particles in a second polymer solution with a second solution solvent permeating into the body for effecting a firm bond between the porous body and the metal particles;

(e) covering the metal particle surface layer with a rapidly curing resin dissolved in a third solvent, the third solvent causing the second polymer to permeate partially from the metal particle layer into the porous body and thereby creating hollow spaces near the metal particles.

2. The process as set forth in claim 1, wherein said first polymer is a polyurethane.

3. The process as set forth in claim 2, wherein the polyurethane is cured at a temperature of from about 80° C. to 150° C.

4. The process as set forth in claim 1, wherein the second polymer is a cyclorubber.

5. The process as set forth in claim 1, wherein the rapidly curing resin is a polyurethane resin.

6. The process as set forth in claim 1, wherein the metal particles are in the form of aluminum platelets.

7. The process as set forth in claim 6, wherein a fourth solvent is dispersed on the surface of the body after the covering of the surface of the body with a dispersion of metal platelets and before the covering of the metal platelet surface layer with a rapidly curing resin.

8. The process as set forth in claim 1, wherein the dispersion of metal particles in a second polymer comprises from about 20 to 50 weight percent aluminum platelets.

9. The process as set forth in claim 1, wherein the dispersion of metal particles in a second polymer solution comprises from about 5 to 10 weight percent of said second polymer.

10. The process as set forth in claim 1, comprising the step of curing the resulting covered body for at least about 10 days.

* * * * *